US009848664B2

(12) United States Patent
Poldoski

(10) Patent No.: US 9,848,664 B2
(45) Date of Patent: Dec. 26, 2017

(54) EYEWEAR RETAINING HEAD COVERING

(71) Applicant: Doug Poldoski, Wabasha, MN (US)

(72) Inventor: Doug Poldoski, Wabasha, MN (US)

( * ) Notice: Subject to any disclaimer, the term of this patent is extended or adjusted under 35 U.S.C. 154(b) by 0 days.

(21) Appl. No.: 14/311,481

(22) Filed: Jun. 23, 2014

(65) Prior Publication Data

US 2015/0366283 A1 Dec. 24, 2015

(51) Int. Cl.
*A42B 1/24* (2006.01)
*A42B 1/00* (2006.01)

(52) U.S. Cl.
CPC ..... *A42B 1/247* (2013.01)

(58) Field of Classification Search
CPC ..... A42B 1/247; A42B 1/24; G02C 3/02
See application file for complete search history.

(56) References Cited

U.S. PATENT DOCUMENTS 3,703,750 A * 11/1972 Irwin, Jr. ..... 24/265 R
3,983,602 A * 10/1976 Barry ..... 24/11 R
4,179,753 A * 12/1979 Aronberg et al. ..... 2/10
4,549,793 A * 10/1985 Yoon ..... 351/156
4,696,556 A * 9/1987 Perry, III ..... 351/157
4,768,231 A * 9/1988 Schrack ..... 2/13
4,781,451 A * 11/1988 McAllen ..... 351/156
4,796,308 A * 1/1989 Bourgeois ..... 2/10
4,852,221 A * 8/1989 Antonucci ..... 24/10 R
4,978,210 A * 12/1990 Lundbeck ..... 351/157
5,052,054 A * 10/1991 Birum ..... 2/10
5,092,667 A * 3/1992 Bagley ..... 351/156
5,102,024 A * 4/1992 Boersma et al. ..... 224/181
5,208,916 A * 5/1993 Kelman ..... 2/10
5,289,592 A * 3/1994 Paivarinta ..... 2/431
5,373,583 A * 12/1994 Birum ..... 2/10
5,408,728 A * 4/1995 Wisniewski ..... 24/3.3
5,422,686 A * 6/1995 Kelman et al. ..... 351/155
5,734,993 A * 4/1998 D'Oca ..... 2/175.3
5,778,448 A * 7/1998 Maher ..... 2/10
5,829,103 A * 11/1998 Allen ..... 24/11 R
5,860,167 A * 1/1999 Lizio ..... 2/209.13
5,862,523 A * 1/1999 Proctor ..... 2/209.11
5,867,874 A * 2/1999 Simpson ..... 24/336
5,894,604 A * 4/1999 Crabb et al. ..... 2/209.13
5,898,935 A * 5/1999 Davis ..... 2/10
5,905,560 A * 5/1999 Daniel ..... 351/157
5,907,868 A * 6/1999 Schleger et al. ..... 2/10
(Continued)

*Primary Examiner* — Bobby Muromoto, Jr.
(74) *Attorney, Agent, or Firm* — Global Intellectual Property Agency, LLC; Daniel Enea

(57) ABSTRACT

Provided is a form-fitting, eyewear retaining head covering made of an elastic material that snuggly fits the contour of a wearer's head. On each side of the head covering is a retention slot designed to receive the arm of a pair of eyeglass frames. The slots are disposed along the lower edge of the head covering and in horizontal alignment therewith. The slots may be reinforced with a high friction material in order to grip the eyeglass frames and reduce slippage. The normal seat and positioning of the head covering is not adjusted by eyewear and the eyewear is disposed in its natural position. The slots are relatively close to one another to minimize the propensity of the hat lower edge to fold backward in high winds, whereby the lower edge of the head covering is stretched to accommodate the arms of the glasses.

10 Claims, 2 Drawing Sheets

(56) References Cited

U.S. PATENT DOCUMENTS

| | | | | |
|---|---|---|---|---|
| 5,930,834 | A * | 8/1999 | Toovey | 2/10 |
| 5,933,871 | A * | 8/1999 | Kraft | 2/209.13 |
| 6,115,843 | A * | 9/2000 | Travalgia | 2/171 |
| 6,237,159 | B1 * | 5/2001 | Martin | 2/209.12 |
| 6,247,177 | B1 * | 6/2001 | Hayes | 2/12 |
| 6,282,721 | B1 * | 9/2001 | Travalgia | 2/171 |
| 6,298,492 | B1 * | 10/2001 | Stirling | 2/206 |
| 6,298,495 | B1 * | 10/2001 | Totani | 2/209.13 |
| 6,397,396 | B1 * | 6/2002 | Vibert | 2/209.13 |
| 6,442,764 | B1 * | 9/2002 | Badillo et al. | 2/209.13 |
| 6,481,059 | B2 * | 11/2002 | Morris | 24/3.12 |
| 6,618,907 | B2 * | 9/2003 | Morris | 24/3.3 |
| 6,637,074 | B1 * | 10/2003 | Morris | 24/3.12 |
| 6,641,266 | B1 * | 11/2003 | Lazarus | 351/155 |
| 6,644,807 | B1 * | 11/2003 | Hood | 351/155 |
| 6,647,554 | B1 * | 11/2003 | Yan | 2/209.13 |
| 6,668,426 | B1 * | 12/2003 | Morris | 24/3.3 |
| 6,671,885 | B2 * | 1/2004 | Viggiano | 2/209.13 |
| 6,792,619 | B1 * | 9/2004 | Morris et al. | 2/10 |
| D503,261 | S * | 3/2005 | Pedersen | D2/882 |
| 6,935,742 | B1 * | 8/2005 | Wilson, Sr. | 351/155 |
| 7,003,809 | B1 * | 2/2006 | Gordon | 2/209.13 |
| 7,013,491 | B2 * | 3/2006 | Ferrara | 2/209.13 |
| 7,051,406 | B1 * | 5/2006 | Morris et al. | 24/3.12 |
| 7,137,151 | B2 * | 11/2006 | Keech | 2/209.13 |
| 7,178,278 | B1 * | 2/2007 | Morris | 40/329 |
| 7,229,168 | B2 * | 6/2007 | Kidouchim | 351/47 |
| 7,275,270 | B2 * | 10/2007 | Cotutsca | 2/209.13 |
| 7,325,920 | B1 * | 2/2008 | Gelfuso | 351/155 |
| 7,340,781 | B2 * | 3/2008 | Clark | 2/209.13 |
| 7,484,845 | B2 * | 2/2009 | Douglas | 351/155 |
| 7,562,977 | B1 * | 7/2009 | Heaton | 351/155 |
| D602,980 | S * | 10/2009 | Heaton | D16/339 |
| 7,703,153 | B2 * | 4/2010 | de Taboada | 2/422 |
| 7,866,813 | B2 * | 1/2011 | Anhalt | 351/155 |
| 7,904,970 | B2 * | 3/2011 | Thomas | 2/209.13 |
| 7,954,943 | B2 * | 6/2011 | Ledford | 351/155 |
| 7,979,920 | B2 * | 7/2011 | Gilman | 2/195.1 |
| 7,979,921 | B2 * | 7/2011 | Cotutsca | 2/209.13 |
| 8,205,985 | B1 * | 6/2012 | Barajas | 351/155 |
| 8,209,778 | B2 * | 7/2012 | Matsumoto | 2/209.13 |
| 8,286,269 | B2 * | 10/2012 | Springer et al. | 2/422 |
| 8,381,359 | B1 * | 2/2013 | McArdle | 24/3.12 |
| D678,663 | S * | 3/2013 | Gill | D2/882 |
| D686,396 | S * | 7/2013 | Rebitzer et al. | D2/889 |
| 8,573,773 | B1 * | 11/2013 | Acosta | 351/155 |
| 8,740,379 | B2 * | 6/2014 | Berger | 351/155 |
| 8,813,265 | B2 * | 8/2014 | Schwantes | 2/209.13 |
| 2002/0069488 | A1 * | 6/2002 | Morris | 24/3.12 |
| 2002/0069489 | A1 * | 6/2002 | Morris | 24/3.12 |
| 2006/0048279 | A1 * | 3/2006 | Bartos | 2/209 |
| 2006/0174398 | A1 * | 8/2006 | Proctor | 2/209.13 |
| 2007/0028360 | A1 * | 2/2007 | Cotutsca | 2/209.13 |
| 2007/0101996 | A1 * | 5/2007 | Carstens | 128/206.12 |
| 2007/0220656 | A1 * | 9/2007 | Cotutsca | 2/171 |
| 2007/0229759 | A1 * | 10/2007 | Jones | 351/200 |
| 2007/0245458 | A1 * | 10/2007 | McGee | 2/195.3 |
| 2008/0054033 | A1 * | 3/2008 | Synness | 224/181 |
| 2009/0284712 | A1 * | 11/2009 | Brooks | 351/155 |
| 2011/0126343 | A1 * | 6/2011 | Tualla et al. | 2/209.13 |
| 2012/0272483 | A1 * | 11/2012 | Moore | 24/3.3 |
| 2013/0033610 | A1 * | 2/2013 | Osborn | 348/207.1 |
| 2013/0047310 | A1 * | 2/2013 | Peebles | 2/15 |
| 2013/0114275 | A1 * | 5/2013 | Cristoforo | 362/396 |
| 2014/0013486 | A1 * | 1/2014 | Leon | 2/209.11 |
| 2014/0315661 | A1 * | 10/2014 | Brown et al. | 473/409 |
| 2015/0013114 | A1 * | 1/2015 | Grame et al. | 24/3.8 |

* cited by examiner

EYEWEAR RETAINING HEAD COVERING

BACKGROUND OF THE INVENTION

Field of the Invention

The present invention relates to active wear and motorcycle haberdashery. More specifically, it relates to a fitted head covering having apertures along opposing sides to receive and retain the arms of eyeglass frames. The head covering snugly conforms to the head of a wearer, thereby reducing the chance that it will be dislodged during use. Eyeglasses or other eye protection are inserted through the apertures in the head covering, trapping a portion of the eyeglass frames between the head covering and a wearer's head. The invention will be appreciated by motorcyclists, bikers, sailors, and other persons participating in activities subject to windy conditions.

Outdoors activities and sports are an exciting form of recreation for many people. These activities can be a fun way to get needed exercise and vitamin D on a pleasant day. But, if the weather includes rain, wind, cool temperatures, or storms, participation in outdoor activities can become extremely unpleasant if not outright infeasible. Vision of participants may become obscured by rain, hair or clothing blown in their face by strong winds. This vision obstruction increases the likelihood of participant injury.

To protect their eyes and reduce vision obstruction, many sports enthusiasts wear protective eyewear. Many other activities include eyewear while outdoors, including riding a motorcycle or cycling at high speeds. Common examples of eyewear employed during physical activity include eyeglasses, sunglasses, and protective goggles. To ensure that eyewear is secured in position during activity, wearers may attach elastic bands to the frame of the eyewear, or pull a hat down over frame arms. Elastic bands may cause bunching if worn over a hat, causing the head covering to dislodge and expose the wear's head. If worn under a hat, the sides of glasses arms, or an elastic band can cause portions of the head covering to ride up, once again exposing portions of the user's head.

In windy or cold environments, exposure of a user's head to environmental elements can be dangerous. High winds will push air into the cap interior through the exposed points. Eventually the build-up of air within the head covering can dislodge the cap. Further, exposure of a wearer's scalp to extreme temperatures may cause risk of frostbite or sunburn. It is desirable for a head covering to fit properly and maintain position during exertion in order to protect the wearer's head.

A form-fitting head covering is needed that incorporates eyewear retention means. By accounting for positioning of eyewear during use of the head covering, the invention will ensure proper fitting of the head covering throughout wear. The present invention provides a snuggly fitted cap with reinforced slots for receiving an retaining the frame arms of eyewear, particularly in high wind environments such as high speed cycling or motorcycle riding. The present invention contemplates horizontal slots along the lower edge of the head covering that accept the arms of the eyewear article therethrough. The distance between the slots along the lower edge of the head covering is reduced to prevent any slackening of the material, which would otherwise be prone to flapping in the wind or folding backwards. Overall, the head covering supports the eyewear in its natural position while forming a close-fitting covering over the head of a wearer.

Description of the Prior Art

Devices have been disclosed in the prior art that relate to head coverings. These include devices that have been patented and published in patent application publications. These devices generally relate to head coverings adapted to support eyewear. The following is a list of devices deemed most relevant to the present disclosure, which are herein described for the purposes of highlighting and differentiating the unique aspects of the present invention, and further highlighting the drawbacks existing in the prior art.

Head coverings of a variety of shapes and styles are well covered in the art of haberdashery. Some of these head coverings incorporate a means for supporting eyewear or restricting the movement of same. Travalgia, U.S. Pat. No. 6,828,721 discloses a head covering having a pair of slots disposed on opposing sides of the covering to accept a pair of glasses. The head covering is constructed from a fitted interior layer and a fabric outer layer that may have numerous shapes and designs.

Several patents have described baseball cap style head coverings that are capable of supporting eyewear. Hood, U.S. Pat. No. 6,644,807 teaches a head covering with a pair of retaining slots. Clips that slideably extend outward are secured to the slots. These clips receive the arms of a pair of eyeglasses and allow the arms to slide in and out of the slots. The form of the Hood device is a baseball cap with a protruding forward brim. In use, a pair of glasses can rest upon the brim, or slide outward past the brim and then reposition on a user's face. Similarly, Viggiano, U.S. Pat. No. 6,671,885 discloses a baseball cap head covering with slits in opposing sides of the cap for receiving the arms of a pair of eyeglasses. Internal securing means such as Velcro, or elastic are disposed within the slots to facilitate restriction of the eyeglass arms. A third Martin, U.S. Pat. No. 6,237,159 teaches a baseball cap having a pair of slots disposed on each side of the cap. The first pair of slots forms a retaining bridge, which the arm of a pair of eyeglasses passes under, while the second pair of slots forms a second bridge adapted to secure the second arm of the eyeglasses.

Another way to secure eyewear to a head covering is disclosed in Cotutsca, U.S. Pat. No. 7,275,270. This head covering does not feature receiving slots, but instead incorporates an exterior adhesive and a covering patch. The covering patch is made of the same or a similar material as the cap to hide the adhesive and trap the arms of a pair of sunglasses between the patch and the exterior of the head covering. An adhesive and a covering patch are disposed on each side of the covering.

These prior art devices have several known drawbacks. They do not provide for a tightly fitting contour-conforming head covering with reinforced slots for insertion of eyewear. The present invention is a form-fitting cap with high-friction material reinforcements around the insertions slots to aid in eyewear retention. It substantially diverges in design elements from the prior art and consequently it is clear that there is a need in the art for an improvement to existing eyewear retention devices. In this regard the instant invention substantially fulfills these needs.

SUMMARY OF THE INVENTION

In view of the foregoing disadvantages inherent in the known types of eyewear retention head coverings now present in the prior art, the present invention provides a new reinforced retention slots wherein the same can be utilized for providing convenience for the user when maintain eyewear positioning during physical exertion The present invention is a cap style head covering. It is directed towards tight fitting caps, sometimes known as skullcaps. These caps are worn over a user's head when riding a motorcycle or bike, when swimming, or participating in any activity where aerodynamic optimization is essential to reduce drag force. In addition to being form-fitting, the perimeter of the head covering opening must be tightly fitting to prevent wind or water from entering the cap interior.

To ensure the tight fit of the cap and accommodate eyeglasses, the head covering has two slots disposed near the area of the cap corresponding to the front of a user's ear. The rim of these slots is reinforced with a material having a high coefficient of friction to reduce slippage of eyeglass frames inserted through the slots. In some embodiments a portion of the cap interior near the slots is also covered in the tacky material to further aid in maintaining eyeglass positioning. Thus, eyeglasses or other protective eyewear can be worn in combination with a cap head covering without altering the normal fit and positioning of the head covering.

It is therefore an object of the present invention to provide a new and improved eyeglass retaining head covering device that has all of the advantages of the prior art and none of the disadvantages.

It is another object of the present invention to provide a form-fitting cap capable of retaining eyeglasses in a desired position without modifying the normal seat of the cap or the natural positioning of the eyewear on the user's head.

Another object of the present invention is to provide a tightly fitted cap that can be worn in combination with protective eyewear, during extreme physical activity, whereby the slots used to accept the arms of the eyewear are horizontal and aligned with the lower edge of the head covering to allow a natural positioning of the eyewear arms into the device and preventing separation thereof.

Yet another object of the present invention is to provide an eyewear retaining dead covering that minimizes drag force on the wearer's head, whereby the slots are disposed in relation to one another such that the lower edge of the head covering is stretched against the wearer's forehead to reduce wind resistance and loose material that may otherwise be caught in the wind.

Still another object of the present invention is to provide a head covering that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
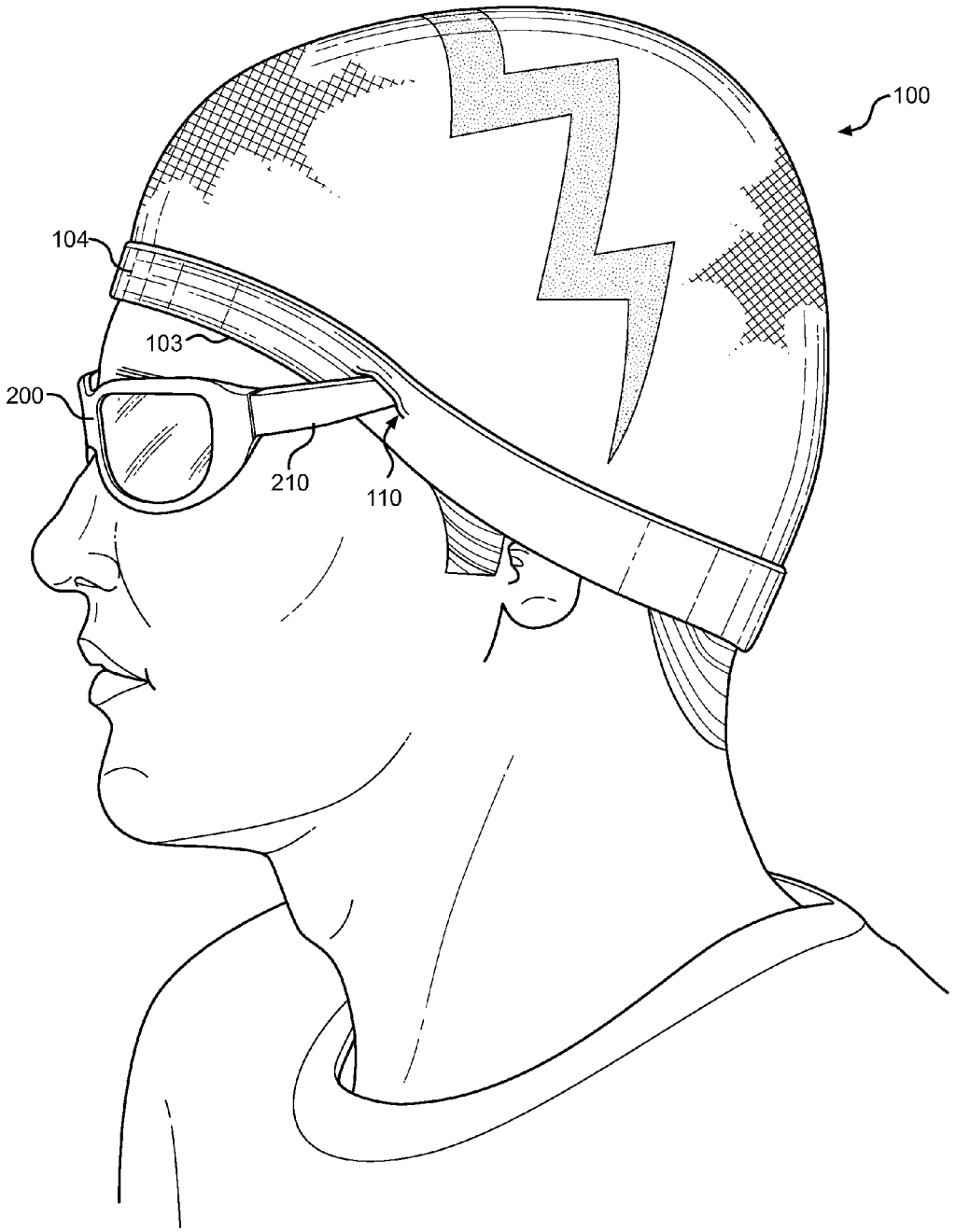
FIG. 1 shows a perspective view of the eyewear retaining head covering in use.

Reference is made herein to the attached drawings. Like reference numerals are used throughout the drawings to depict like or similar elements of the eyewear retaining head covering. For the purposes of presenting a brief and clear description of the present invention, the preferred embodiment will be discussed as used for retaining eyewear in a desired position. The figures are intended for representative purposes only and should not be considered to be limiting in any respect.

Referring now to FIG. 1, there is shown an exemplary embodiment of the head covering in use. The cap 100 is a tightly form-fitting head covering that extends over the crown of a wearer's head and down onto the forehead. The cap covers most of the wearer's ears to protect them from environmental exposure and to flatten them close to the head, thereby reducing drag cause by the ears. When properly fitted the cap creates a rounded profile along the back of the head, and leaves the neck area uncovered.

A pair of sunglasses 200 worn by the user is held in place by the cap. The arms 210 of the sunglasses frame are inserted through small retention slots 110 disposed along the lower edge of the cap and at a given distance from one another. These slots are small apertures extending through the cap to permit insertion and removal of an eyeglass frame arm therethrough. In a preferred embodiment the slots are positioned on the cap in an area forward of their natural positioning to accept the arms 210 of the eyewear 200 such that the lower edge 103 of the head covering must be stretch across the forehead of the wearer to adequately align the arms 210 with the slots 110. This positioning places the slots 110 both within the same forward third of the head covering lower edge perimeter, wherein the lower edge forms a complete circle. At a minimum, the separation of the slots 110 places the slots 110 in the same half of the lower edge perimeter. Once inserted, the cap permits normal seating of a wear's eyeglasses, with the frame arms 210 resting on top of the wearer's ears and the hooked portion of the arms wrapping around behind the ear. The form-fitting material of the cap presses inserted frame arms 210 against the user's head thereby reducing wiggle room. The forward portion 104 of the head covering lower edge is stretched across the brow or forehead of the wearer to ensure a form-fitting and seamless transition between the brow and the head covering, thereby reducing wind resistance.

The orientation of the slots 110 is such that they are aligned with the lower edge 103 of the head covering, and are therefore substantially horizontal, as opposed to vertical. This orientation allows the arms 210 to more readily nest within the slots 110 and for the slots 110 to readily catch the arms 210 in their natural positioning between the wearer's eyes and ears. The horizontal orientation also facilitates stretching of the forward portion 104 of the head covering lower edge once the arms 210 of the eyewear are inserted and donned, reducing wind resistance by ensuring a taught configuration of the lower edge 103 across the forehead of the wearer.

Figure 2:
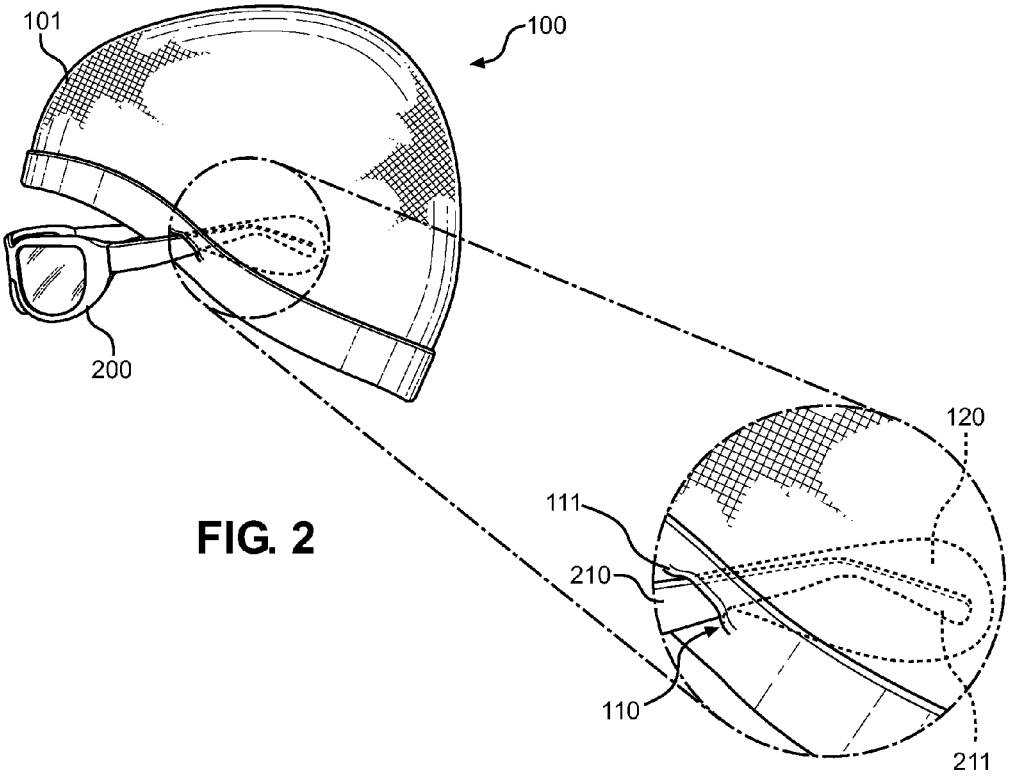
FIG. 2 shows an exploded view of the arm of an eyeglasses frame inserted through a retention slot. Position of the frame arm with respect to tacky portions of the head covering is shown in detail.

Turning now to FIG. 2, there is shown a close-up of the eyeglasses frame arm inserted through a retention slot. During normal use, the outer surface 101 of the cap 100 is exposed to the environment, while an interior surface (not shown) is hidden within the cap interior. Frame arms 210 of pair of glasses 200 are inserted through retention slots 110 in the side of the cap. In a preferred embodiment the perimeter of the retention slot is reinforced with a material having a high coefficient of friction. The reinforcement 111 may extend outward onto the outer surface of the cap, or may cover only the interior surface around the retention slot. Some embodiments of the device will further comprise a reinforcing path 120. This is a patch of the same tacky material that extends along the interior surface from the retention slot backward, to cover an area corresponding to the user's upper ear. Placement of high friction material along the area nearest to the hooked end 211 of an eyeglass arm frame, further reduces the chance that the glasses will shift during use, because the arm is in constant tactile connection with the tacky material.

Reinforcement of the retention slots with a highly tacky material is an essential aspect of the present invention. This feature greatly reduces the ability of eyeglass frame arms to slip along the retention slot opening during wear. Additionally, the reinforcement helps protect the retention slot from material fray. In some embodiments the high friction material may be a coating of a substance such as rubber. In other embodiments, the reinforcing material may be an additional layer bonded to the interior surface.

Figure 3:
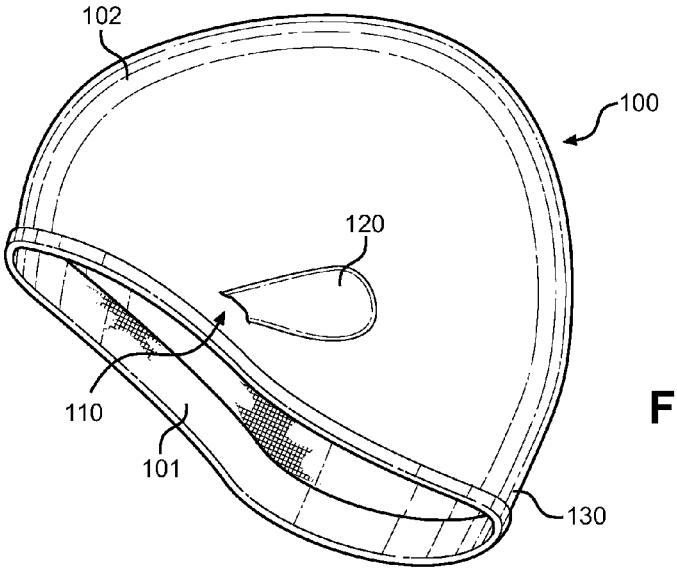
FIG. 3 shows a perspective view of the head covering interior. The device is inverted to show the key features of tacky portions of the interior.

Placement of the high-friction material is best illustrated in FIG. 3. The cap is in an inverted position with the interior surface 102 exposed and the outer surface 101 facing inward. This inversion is for demonstrative purposes only and is not used in the normal course of wear. Along the area corresponding to a user's ear is a retention slot 110 and associated reinforcement patch 120. The illustrated embodiment further includes a band 130 of high-friction material along the portion of the interior surface surrounding the perimeter of the opening. This band contacts portions of the user's skin when in use, gently "gripping" the skin's surface to reduce abrasion resulting from constant rubbing of the skin. Additional grip along the bottom of the cap assist in maintaining cap position during wear and consequently reduces pulling on seated eyeglasses.

In use, a person places the cap on his head and pulls down on the opening until a tight fit is obtained. The hooked ends of a pair of eyeglasses are then inserted through the retention slots on either side of the cap. Accompanying frame arms are gently threaded through the retention slots until the hooked portions are in place behind the user's ears. The nose bridge of the glasses is then lowered onto the user's nose and the frame adjusted until the fit is comfortable. Another tug on the bottom of the cap may be necessary to re-tighten the fit. The user is then free to ride a motorcycle or go swimming without fear of losing their cap or glasses.

The present invention is an eyewear retention head covering adapted for use during extreme physical activity. The cap is form fitting and conforms to the contour of a wearer's head. It has a reinforcing slot disposed on each side of the cap to receive the arm of a pair of eyeglasses. Reinforcing areas of high-friction material reduce slippage of eyeglasses inserted through the retention slots. The head covering may be made from a variety of materials so long as the material is elastic.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A form-fitting eyewear retaining head covering device comprising:

an elastic cap having a dome-shape, an interior surface, an outer surface, a forward portion, and a lower edge;

said lower edge forming a circle;

a first retaining slot and a second retaining slot extending through said cap and disposed adjacent to said lower edge;

said first retaining slot and said second retaining slot being aligned with said lower edge and positioned along said forward portion of said elastic cap;

a retaining patch extending from each of the first retaining slot and the second retaining slot along the interior surface, the retaining patch comprising a high-friction material;

said retaining patch comprising an open end and a closed end, wherein said retaining patch is configured to receive a temple of an eyewear;

wherein the high-friction material of the retaining patch is configured to support a temple tip of an eyewear thereagainst when a temple of the eyewear is inserted through one of the retaining slot and the second retaining slot;

said first retaining slot and said second retaining slot are disposed a given distance from one another along said lower edge;

said given distance comprising a distance that causes said lower edge to stretch between said first retaining slot and said second retaining slot when accepting the arms of an eyewear article therethrough when in their extended state.

2. The head covering device of claim 1, wherein said forward portion comprises a forward third of said complete circle.

3. The head covering device of claim 1, wherein said forward portion comprises a forward half of said complete circle.

4. The head covering device of claim 1, wherein said first retention slot and said second retention slot are reinforced with a ring of high-friction material.

5. The head covering device of claim 4, wherein said ring extends along both the outer surface and interior surface surrounding each of said retention slots.

6. The head covering device of claim 1, wherein the retaining patch extends over an area corresponding to a user's upper ears when in use.

7. The head covering device of claim 1, further comprising:

a reinforced band of high-friction material extending around said interior surface of said cap along said lower edge.

8. The head covering device of claim 1, wherein said high-friction material is a coating applied to said cap.

9. The head covering device of claim 1, wherein said high-friction material is a layer of material bonded to said cap.

10. The head covering device of claim 7, wherein said first retaining slot and said second retaining slot are disposed on said reinforced band of high-friction material.

* * * * *